US009650112B1

(12) United States Patent
Milam et al.

(10) Patent No.: US 9,650,112 B1
(45) Date of Patent: May 16, 2017

(54) FLOTATION DEVICE FOR A SHOT GUN

(71) Applicants: Brian E. Milam, Meraux, LA (US); Joseph E. Bellande, IV, Meraux, LA (US)

(72) Inventors: Brian E. Milam, Meraux, LA (US); Joseph E. Bellande, IV, Meraux, LA (US)

( * ) Notice: Subject to any disclaimer, the term of this patent is extended or adjusted under 35 U.S.C. 154(b) by 0 days.

(21) Appl. No.: 14/680,481

(22) Filed: Apr. 7, 2015

(51) Int. Cl.
*B63B 22/12* (2006.01)
*B63B 22/08* (2006.01)
*F41C 27/00* (2006.01)

(52) U.S. Cl.
CPC ..... *B63B 22/08* (2013.01); *B63B 22/12* (2013.01); *F41C 27/00* (2013.01)

(58) Field of Classification Search
CPC ..... B63B 22/08; B63B 22/12; F41C 27/00
USPC ..... 441/9
See application file for complete search history.

(56) References Cited

U.S. PATENT DOCUMENTS 3,049,733 A * 8/1962 Mennenga ..... A01K 97/24 116/209
3,314,088 A * 4/1967 Nordhaus ..... B63B 22/10 102/408
3,581,352 A * 6/1971 Lavin ..... D06F 39/081 102/408
3,624,849 A * 12/1971 Brannaker ..... B63B 22/10 43/23
4,749,198 A 6/1988 Brailean
5,156,562 A 10/1992 Pearson
5,165,562 A * 11/1992 Raney ..... B65D 43/0216 220/783
5,310,820 A * 5/1994 Nelissen ..... C08F 283/08 525/391
5,857,881 A * 1/1999 Zippel, Sr. ..... B63C 9/15 43/25
6,036,559 A 3/2000 Arnold et al.
6,755,708 B1 6/2004 McLarty
7,232,354 B2 * 6/2007 Olson ..... B63B 22/12 441/7
7,540,796 B2 * 6/2009 Spears ..... B63B 22/08 441/8
8,105,124 B2 1/2012 Williams
(Continued)

*Primary Examiner* — Anthony Wiest
(74) *Attorney, Agent, or Firm* — Suzanne Kikel, Patent Agent

(57) ABSTRACT

A shot gun flotation device includes an inflatable arrangement comprising a water sensitive mechanism; an inflatable bladder; and a source of gas for inflating the inflatable element. Housing has a first tubular section attached to the shot gun, a tubular transition section, and a second tubular section for housing the inflatable arrangement. A further embodiment comprises an attachment adapter, a frame, and a sheath. The attachment adapter includes a first end section with threads for attachment to the shot gun, a middle section for mounting a ring, and a second end section with external threads for engaging the frame. The frame supports an inflatable arrangement and a sheath houses the inflatable arrangement and the frame when in an inoperative state. Further embodiments include an inflatable arrangement with a bladder stored in housing and a $CO_2$ cartridge for inflating the bladder when the inflatable arrangement is activated.

8 Claims, 6 Drawing Sheets

(56) References Cited

U.S. PATENT DOCUMENTS

| | | | | |
|---|---|---|---|---|
| 8,720,363 | B2 * | 5/2014 | Weatherford | F41A 35/00<br>116/209 |
| 2005/0188594 | A1 * | 9/2005 | Tilby | F41C 23/02<br>42/85 |
| 2010/0205844 | A1 | 8/2010 | Williams | |
| 2012/0174854 | A1 | 7/2012 | Weatherford | |
| 2013/0047912 | A1 | 2/2013 | Bell | |

* cited by examiner

FLOTATION DEVICE FOR A SHOT GUN

BACKGROUND OF THE INVENTION

1. Field of the Invention

The present invention relates to an inflatable flotation device, and more particularly, to an inflatable flotation device which is easily attached to a shot gun or the like.

2. Brief Description of the Prior Art

A problem sometimes encountered, particularly during water related sports such as fishing and duck hunting, is the accidental dropping of expensive gear into a body of water. For example, a shotgun or rifle may inadvertently fall into a water body during hunting, target shooting, or the like. Unless the body of water is shallow, retrieval of the article, that is, shot gun or rifle can be nearly impossible and/or dangerous without additional equipment, such as, scuba diving equipment.

Once an article is submerged, the article may be difficult to locate because of the depth and opacity of the water and/or because of the tendency of the water currents to move the article from the location where it was initially submerged. In addition to the water currents, other conditions of the water may make it dangerous or difficult to retrieve the submerged article. For example, the depth of the water may prevent the searcher from spending a sufficient period of time on the water floor in attempt to locate the submerged article. The water temperature may prevent the searcher from entering the water or may limit the amount of time that the searcher can remain in the water without detrimentally affecting the searcher in conducting his search. And, animals or sea creatures may make entering the water in order to conduct the search a dangerous proposition.

Flotation devices for use with submerged articles have been devised. For example, such a flotation device is disclosed in U.S. Pat. No. 6,036,559. This flotation device can be used with a fishing rod. An inflatable balloon is stuffed into a casing with a water-actuated valve and a cartridge with compressed gas. The casing is directly attached to the fishing pole. If the fishing pole should happen to fall into the water, the balloon will inflate causing a cap which encloses the balloon in the casing to blow off and the balloon ejected, thereby bringing the submerged article to the surface. While the inflated balloon may come to the surface of the water, the cap generally falls to the water floor. As a result, in general, this flotation device may only be used once.

Another flotation device is disclosed in U.S. Pat. No. 5,857,881. This device is disclosed for specific use with a fishing rod. This device includes a hard casing for holding the flotation components, which inherently prevents inadvertent actuation. The hard casing and components of this flotation device may generally increase the cost of this flotation device.

In addition to the above deficiencies described hereinabove with regard to the prior art flotation devices, these flotation devices may add weight to the article, and in some instances, the flotation device may be cumbersomeness and poorly located on the article.

There is, therefore, a need to provide a submerged article recovery device which is conveniently located on the article.

There is a further need to provide a submerged article recovery device which will not interfere with the normal operation of the article.

And yet, a further need is to provide a submerged article recovery device which is easily attached to an article.

SUMMARY OF THE INVENTION

The present invention has met these needs. The present invention provides a flotation device mounted on an article, such as a shotgun. The flotation device can easily be mounted on the shotgun, will not interfere with the normal operation of the shotgun, and will nevertheless be activated causing the shot gun to float to the water surface should the shot gun be accidentally dropped into the water during use.

In a first embodiment of the invention, the flotation device comprises a hollow housing which is threadedly attached to one end of the shotgun. The housing has a closure cap frictionally mounted on the housing to close the housing in a watertight manner. A ring is mounted on the housing and has a connecting element for connecting a strap or sling of the shot gun thereto. The flotation device further includes an inflatable arrangement comprising a water sensitive mechanism which is set to activate when the shotgun is submerged in water; an inflatable balloon; and a source of gas for inflating the inflatable balloon. When the shot gun falls into the water, the water sensitive mechanism is activated to inflate the inflatable balloon. The source of gas is fluidically connected to the inflatable balloon via the water sensitive mechanism to inflate the inflatable balloon when the water sensitive mechanism is activated upon the shotgun entering water. The closure cap is mounted on the housing in a manner so that the closure cap is forced away from the housing when the inflatable balloon is inflated, and the inflatable balloon moves outside the housing to float the shotgun to the water surface.

In this first embodiment, the housing of the flotation device includes a first tubular section releasably mounted to the shotgun, a tubular transition section unitary with the first tubular section, and a second tubular section unitary with the tubular transition section. The closure cap is frictionally mounted on the second tubular section to close the second tubular section in a watertight manner when the closure cap is in place on the second tubular section. The tubular transition section defines a recessed section for receiving a ring which can be used for attaching a strap to the shot gun. The first tubular section, the second tubular section, and the tubular transition section are of a unitary construction. These latter sections may be plastic injection molding; plastic; metal or a combination thereof.

In a second embodiment of the invention, the flotation device comprises an attachment adapter, a frame, and a sheath, all of which are attached to one end of the shotgun. A ring is mounted on the attachment adapter which serves as a connection point for attaching a strap or sling to the shotgun. The flotation device further includes an inflatable arrangement comprising a water sensitive mechanism, an inflatable bladder, and a source of gas for inflating the inflatable bladder. The source of gas is fluidically connected to the inflatable bladder via the water sensitive mechanism to inflate the inflatable bladder when the water sensitive mechanism is activated upon the shotgun encountering water. The sheath encompasses the inflatable arrangement in a manner so that the sheath opens when the flotation device is activated. The inflatable bladder deploys to float the shot gun to the water surface.

In this second embodiment, the attachment adapter comprises a three-stepped tubular section which is threadedly mounted to an end of the shot gun and which has a middle section for receiving a ring for attaching a strap of the shot gun, and a threaded end section for threadably attaching the frame to the attachment adapter. The frame is rigidly attached to the threaded end section of the attachment adapter while the water sensitive mechanism, the inflatable bladder, and the source of gas of the inflatable arrangement are mounted to the frame. The sheath encapsulates the frame and the inflatable arrangement.

Additional systems, methods, features, and advantages of the invention will become better apparent to one skilled in the art upon examination of the following figures and detailed description. It is intended that all such additional systems, methods, features, and advantages be included within this description, be within the scope of the invention, and be protected by the following claims.

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 1:
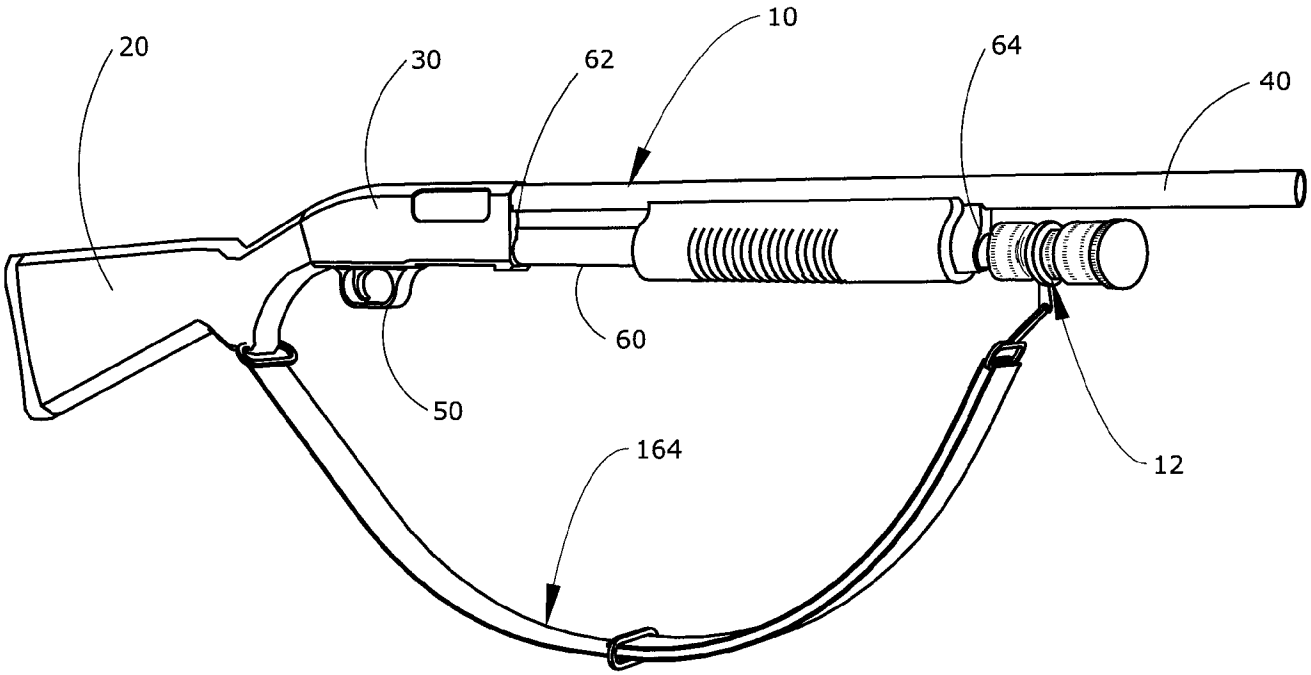
FIG. 1 is a perspective view of a shot gun with a flotation device of a first embodiment of the present invention.
Figure 2:
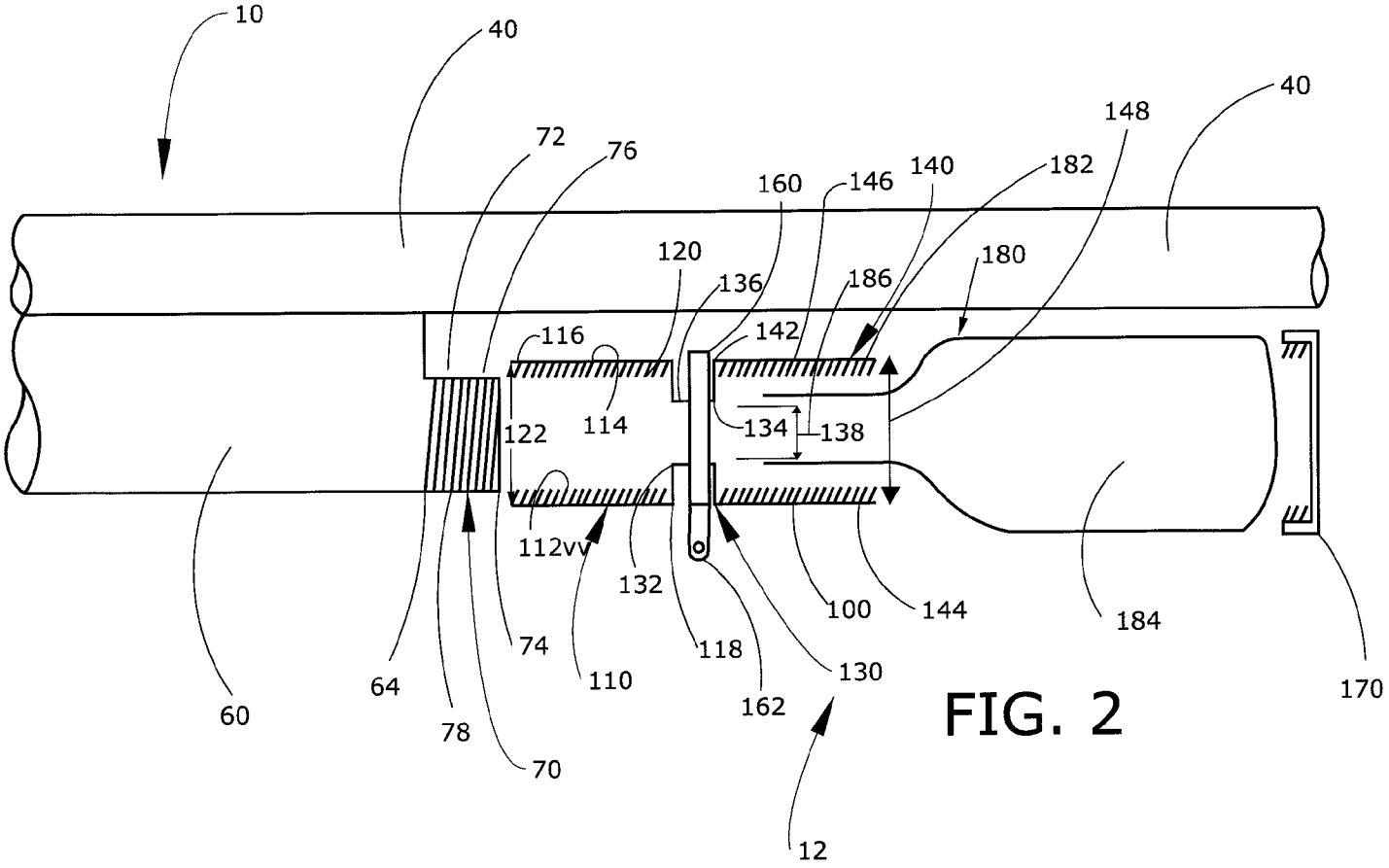
FIG. 2 is an enlarged exploded side view of the flotation device of FIG. 1 with the flotation device in an activated state.
Figure 3:
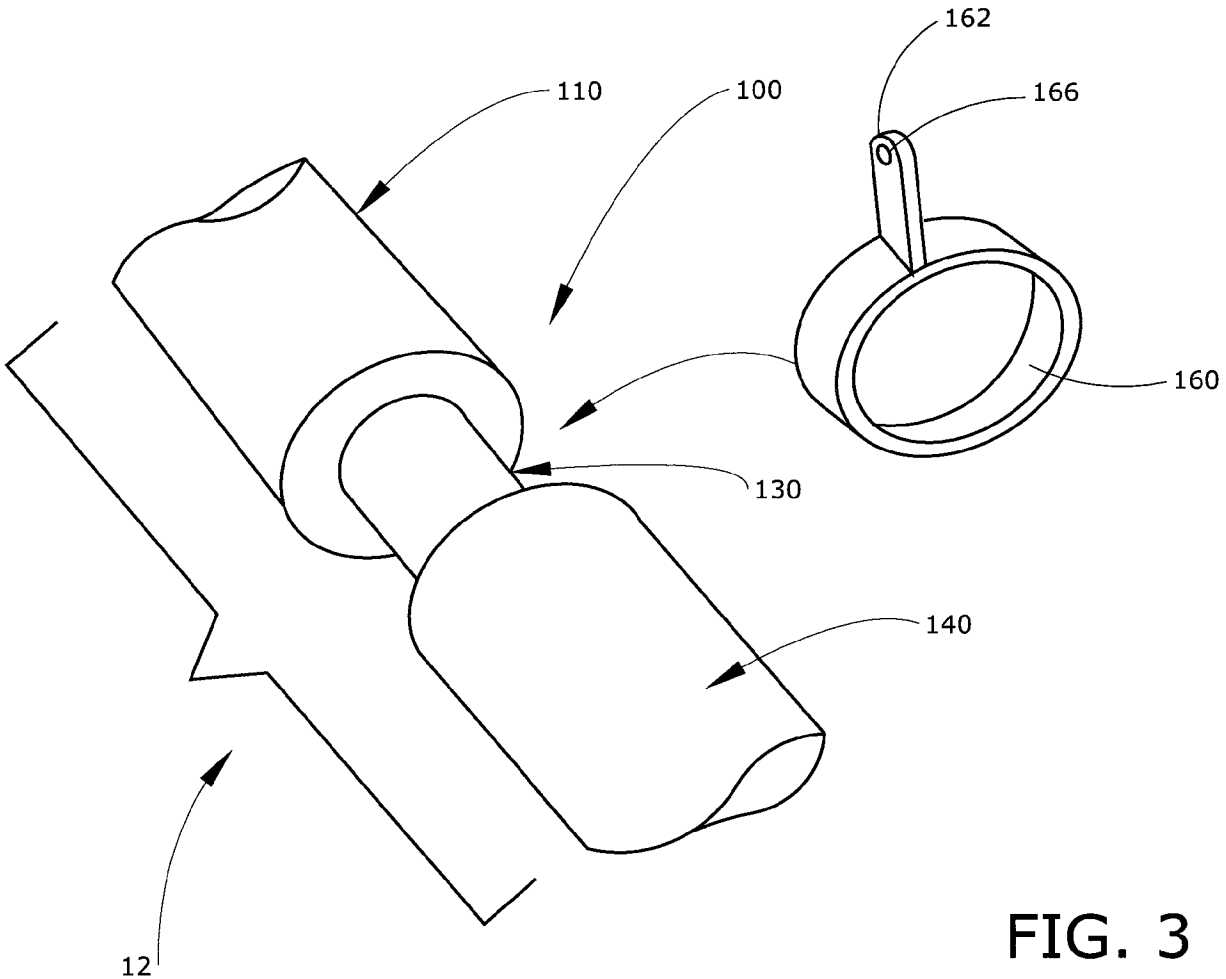
FIG. 3 is an enlarged, exploded partial perspective view of housing 100 and ring 160 of the flotation device of FIG. 2.

Referring to FIGS. 1, 2 and 3, the first embodiment of the invention includes a shot gun 10 and a flotation device 12 attached to the shot gun 10. The flotation device 12 is designed to float the shot gun 10 to the surface of the water when the shot gun 10 falls into the water. Flotation device 12 is further designed to be easily attached to shot gun 10 while at the same time not interfering with the normal operation of the shotgun. That is, flotation device 12 is easily installed and does not interfere with the balance or operation of shot gun 10.

Referring particularly to FIG. 1, in addition to flotation device 12, shotgun 10 further comprises a butt stock 20; a receiver 30 attached to butt stock 20; a barrel 40 attached to receiver 30; and a trigger guard 50 mounted on receiver 30. A magazine tube 60 is mounted beneath barrel 40 and supports flotation device 12. Magazine tube 60 has a proximal end 62 located near receiver 30 and a distal end 64. It is to be understood that magazine tube 60 is mounted thereon for operation of shot gun 10.

The manner in which flotation device 12 is attached to magazine tube 60 is best shown in FIG. 2. In FIG. 2, a connection element 70 is located on distal end 64 of magazine tube 60. In an embodiment of the invention, connection element 70 comprises: a proximal end 72 which is integral with distal end 64 of magazine tube 60; a distal end 74; an external surface 76; and external threads 78 on external surface 76. External threads 78 extend on external surface 76 from distal end 64 of magazine tube 60 to distal end 74 of connection element 70. The external threads 78 on external surface 76 are used to releasably attach flotation device 12 onto magazine tube 60. More specifically, flotation device 12 is releasably mounted onto the distal end 64 of magazine tube 60 by means of connection element 70 via external threads 78.

Referring briefly to FIG. 3, flotation device 12 comprises a housing 100. In turn, housing 100 comprises a first tubular section 110; a tubular transition section 130; and a second tubular section 140.

Referring again to FIG. 2, first tubular section 110 has an internal surface 112, an external surface 114, a proximal end 116, a distal end 118, and internal threads 120 on internal surface 112. Internal threads 120 are defined on the internal surface 112 of the first tubular section 110 and adjacent to the proximal end 116 of first tubular section 110. Internal threads 120 on internal surface 112 of first tubular section 110 cooperatively engage the external threads 78 on external surface 76 of connection element 70 to threadably couple housing 100 of flotation device 12 to the distal end 64 of magazine tube 60. First tubular section 110 additionally has a first external diameter 122 as measured with respect to external surface 114. First external diameter 122 is shown in FIG. 2 adjacent to distal end 74 of connection element 70.

Still referring to FIGS. 2 and 3, housing 100 of flotation device 12 further comprises tubular transition section 130 which is located between first tubular section 110 and second tubular section 140. Tubular transition section 130 has a proximal end 132 which is unitary with distal end 118 of first tubular section 110 of housing 100. As best shown in FIG. 2, tubular transition section 130 further comprises a distal end 134, an external surface 136, and an external diameter 138 which is measured with respect to the external surface 136 and which is smaller than the external diameter 122 of first tubular section 110.

Still referring to FIG. 2 and as stated herein above, housing 100 of flotation device 12 further comprises second tubular section 140. Second tubular section 140 has a proximal end 142, a distal end 144, an external surface 146, and an external diameter 148 which is measured with respect to the external surface 146 and which is equal to the external diameter 122 of first tubular section 110. The proximal end 142 of second tubular section 140 of housing 100 is unitary with distal end 134 of tubular transition section 130.

As best shown in FIGS. 2 and 3, tubular transition section 130 defines a stepped or recessed section which is located between first tubular section 110 and second tubular section 140. As shown in FIG. 2, a ring 160 is mounted around tubular transition section 130 of housing 100 of flotation device 12. Ring 160 includes a bracket 166 with an aperture 162 for connecting strap 164 (FIG. 1) to shot gun 10. This connection is achieved through suitable means (not shown) which are inserted into aperture 162 of ring 160.

Referring particularly to FIG. 2, housing 100 of flotation device 12 further comprises a closure cap 170. Closure cap 170 is frictionally mounted onto second tubular section 140 and adjacent to distal end 144 of second tubular section 140 so as to close second tubular section 140 in a watertight manner when closure cap 170 is in place and secured to second tubular section 140. As can be appreciated, FIG. 2 illustrates enclosure cap 170 as being detached from second tubular section 140. This condition occurs when flotation device 12 has been activated. Closure cap 170 may contain an attachment mechanism for securing a wire or string or the like which will extend from closure cap 170 to ring 162 so as to secure closure cap 170 to ring 162 when flotation device 12 is activated. This arrangement allows closure cap 170 to still be attached to flotation device 12 when closure cap 170 is blown away from the second tubular section 140 when inflatable balloon 184 is deployed or inflated.

Still referring to FIG. 2, flotation device 12 further comprises an inflatable arrangement 180 which comprises a water sensitive mechanism 182, an inflatable balloon 184, and a source of compressed gas 186. Water sensitive mechanism 182 and the source of compressed gas 186 even though not clearly shown in the figures, are well-known to those skilled in the art. As well known to those skilled in the art, inflatable balloon 184 when in an inflatable state floats shotgun 10 to the surface of the water. Similar flotation inflatable arrangements for various articles which are accidentally dropped into water are known in the art. Further examples of devices and/or systems are disclosed in U.S. Pat. Nos. 3,049,733; 3,314,088; 3,581,352; 3,624,849; 5,165,562; 5,310,820; 7,232,354; 7,540,796; 8,105,124; and 8,720,363, the disclosures of which are incorporated herein by reference.

Inflatable balloon 184 is generally housed in the second tubular section 140. In a manner well-known to those skilled in the art, inflatable balloon 184 is associated with water sensitive mechanism 182. Water sensitive mechanism 182 is known in the art and therefore details thereof are not necessary in this disclosure.

As discussed herein above, inflatable balloon 184 is located in second tubular section 140 in a collapsed state for operation of flotation device 12. Inflatable balloon 184 is also well-known in the art and therefore details of inflatable balloon 184 are not necessary in this disclosure. A source of compressed gas 186 for inflating balloon 184 is also located inside housing 100 of flotation device 12. Compressed gas source 186 is known in the art and therefore details thereof are not necessary in this disclosure. In a manner well-known to those skilled in the art, gas source 186 is fluidically connected to the inflatable balloon 184 and is fluidically connected to water sensitive mechanism 182 to inflate the inflatable balloon 184 when water sensitive mechanism 182 is activated which generally occurs when shot gun 10 is accidentally dropped into the water.

As stated herein above, closure cap 170 is mounted on second tubular section 140 in a manner so that the closure cap 170 is forced away from second tubular section 140 when inflatable arrangement 180 is activated or deployed.

In a preferred embodiment of the invention, the components of housing 100, that is, components 110, 130 and 140 are integrally connected. That is, components 110, 130 and 140 are unitary in that they are manufactured as one piece. In an embodiment of the invention, housing 100 is made via an injection molding process. Housing 100 may be comprised of plastic or metal or a combination thereof, or any suitable material. These components may be comprised of a plastic injection molding.

It is to be further appreciated that flotation device 12 is in an inoperative state when the flotation device 12 is mounted onto the connection element 70 of magazine tube 60. It is to be further appreciated that inflatable balloon 184 can be deflated and stuffed back into second tubular section 140 since the water pressure sensitive switch 182 and compressed gas source 186 are still intact after inflatable balloon 184 is inflated and after inflatable balloon 184 brings shot gun 10 to the water surface.

Figure 4:
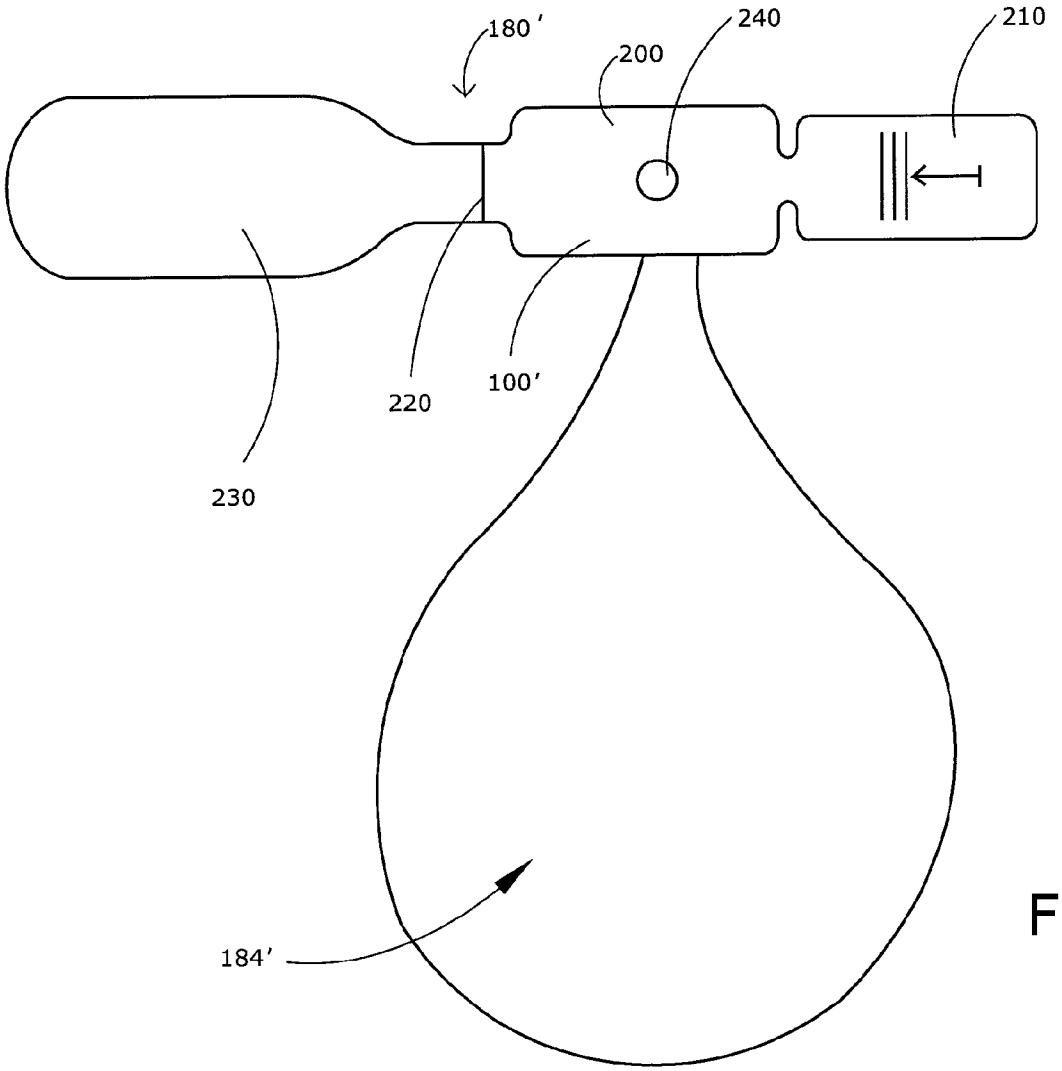
FIG. 4 is an enlarged schematic illustrating a second embodiment of an inflatable arrangement for use in the flotation device of the invention.

FIG. 4 shows an alternate form for an inflatable arrangement 180' for use in the first and second embodiments of the invention. A floatable bladder 184' is attached to housing 100' on a surface 200 thereof to extend out of the side of housing 100' when inflated as shown in FIG. 4. Housing 100' contains a trigger mechanism 210 which is activated upon contact with water to force a pin (not shown) into a closure cover located on end 220 of $CO_2$ cartridge 230. The $CO_2$ cartridge 230 is fluidically connected to bladder 184' to inflate bladder 184' when the closure cover located on end 220 is pierced. The bladder 184' is stored in housing 100' to move out of an aperture 240 defined through the side of housing 100' as can be appreciated from FIG. 4. Inflatable arrangement 180' is mounted to a shot gun in a manner discussed above with regard to inflatable arrangement 180 of FIG. 2.

Figure 5:
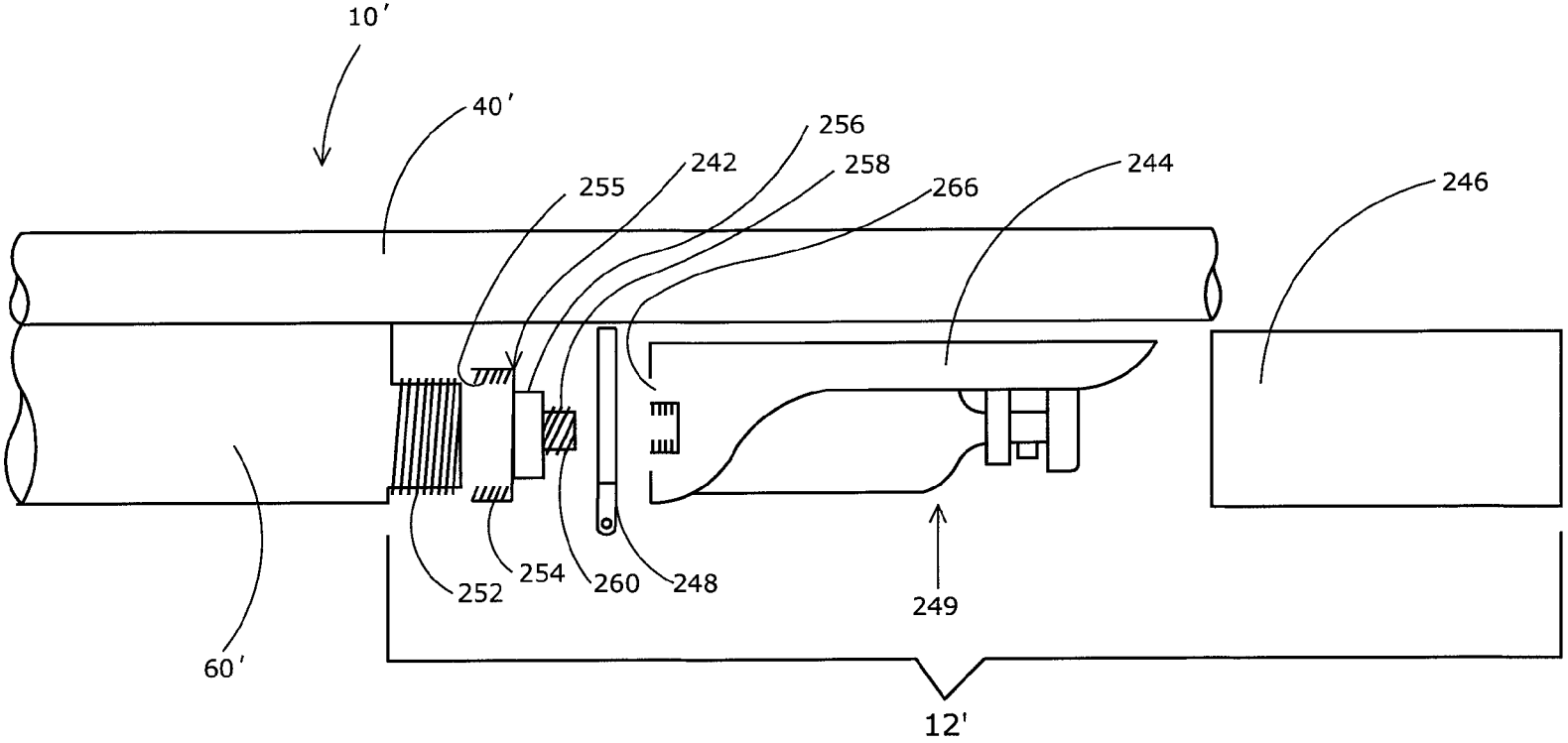
FIG. 5 is an enlarged exploded side view of a second embodiment for a flotation device of the present invention attached to a shot gun.

FIG. 5 illustrates a second embodiment of the invention. Flotation device 12' comprises an attachment adapter 242; a frame 244; and an enclosure cover or sheath 246 attached to magazine tube 60' of shot gun 10'. On the attachment adapter 242, a ring 248 is mounted and serves as a connection point for attaching a strap or sling to shotgun 10'. Flotation device 12' further comprises an inflatable arrangement 249 which may comprise a water sensitive mechanism, an inflatable bladder, and a source of gas for inflating the inflatable bladder in a manner well-known to those skilled in the art and as mentioned herein above with respect to the first embodiment of the invention. The source of gas is fluidically connected to the inflatable bladder via the water sensitive mechanism to inflate the inflatable bladder when the water sensitive mechanism is activated upon the shotgun encountering water. The sheath 246 encircles and houses inflatable arrangement 249 and frame 244 when the inflatable arrangement 249 is in an inoperative condition. The sheath 246 houses inflatable arrangement 249 and frame 244 in a manner so that sheath 246 is forced away from frame 244 when inflatable arrangement 249 is activated or in an operation state. The inflatable bladder of the inflatable arrangement 249 deploys to float shot gun 10' to the water surface.

In this second embodiment of FIG. 5, attachment adapter 242 comprises a three-tiered tubular section which is threadedly mounted to the threads 252 of magazine tube 60'. This tubular section comprises a first end section 254 with internal threads 255; a middle section 256; and a second end section 258 with external threads 260. First end section 254 with internal threads 255 engages threads 252 of magazine tube 60'. Middle section 256 receives ring 248 which, as stated hereinabove, is used to attach a strap or sling to shot gun 10'. Frame 244 has internal threads 266 which engage the external threads 260 of second end section 258 of attachment adapter 242 to rigidly secure frame 244 to attachment adapter 242.

In a well-known manner and even though not shown in FIG. 5, inflatable arrangement 249 includes a water sensitive mechanism, an inflatable bladder, and a source of gas. As shown in FIG. 5, inflatable arrangement 249 is mounted to frame 244. The sheath 246 encapsulates frame 244 and the inflatable arrangement 249 and when inflatable arrangement is deployed, sheath 246 is forced away from frame 244 so that the inflatable bladder such as that, for example, shown at 184' in FIG. 4 is inflated to bring shot gun 10' to the water surface.

Figure 6:
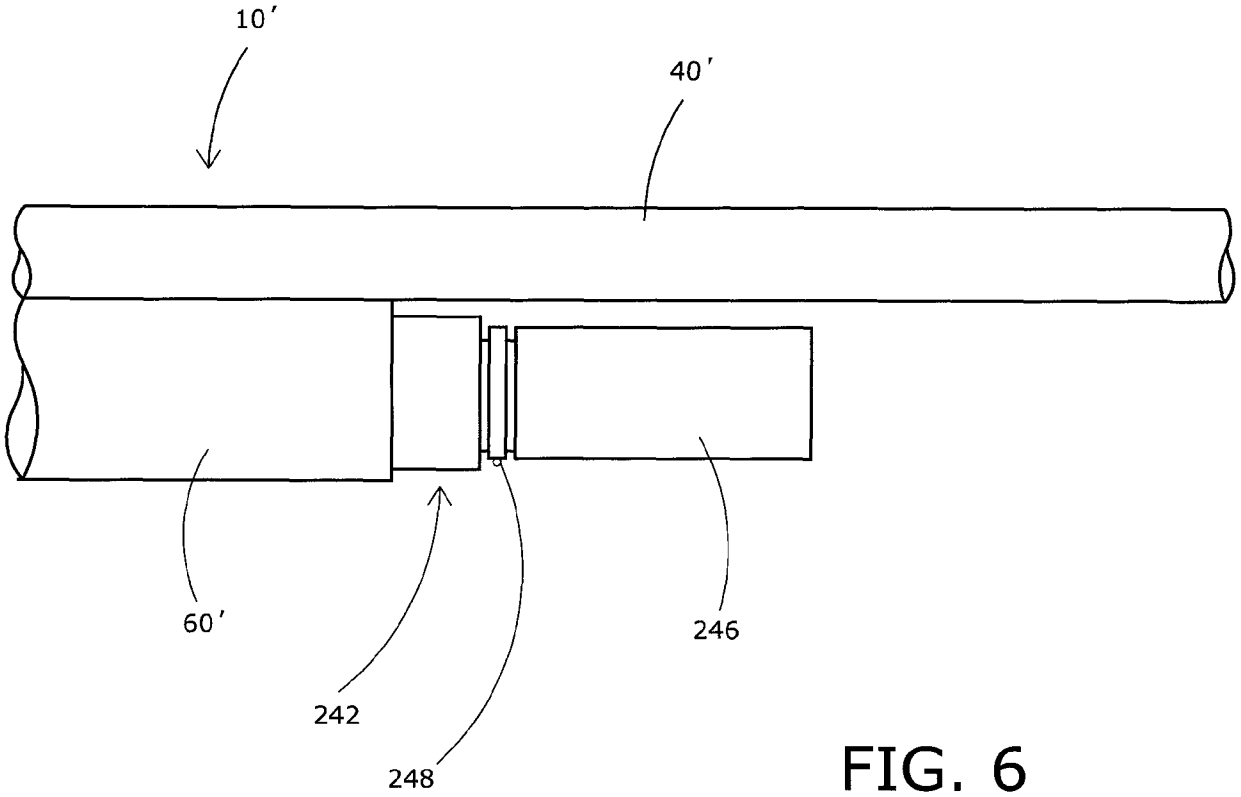
FIG. 6 is a side view of the flotation device of FIG. 5 in assembled form on a shot gun.

FIG. 6 illustrates the flotation device 12' of FIG. 5 in assembled form on a shot gun 10'.

An inflatable arrangement also suitable for use in this second embodiment of FIG. 5, is the inflatable arrangement 180' illustrated in FIG. 4.

While the flotation device of the invention has been described herein as associated with a shot gun, it is to be appreciated that the flotation device may be used with other articles, such as, for example, rifles and fishing rods.

While the present invention has been described in connection with the preferred embodiments of the various figures, it is to be understood that other similar embodiments may be used or modifications and additions may be made to the described embodiment for performing the same function of the present invention without deviating there from. Accordingly, it is intended by the appended claims to cover all such changes and modifications as come within the spirit and scope of the invention.

What is claimed is:

1. A flotation device mounted on a shot gun, the flotation device comprising a housing;

the housing comprising:

a first tubular section having an internal surface, an external surface, a proximal end, a distal end, and internal threads defined on the internal surface of the first tubular section adjacent to the shot gun, the first tubular section having a first external diameter;

a tubular transition section having a proximal end unitary with the distal end of the first tubular section of the housing, a distal end, and an external surface, the external surface of the tubular transition section having an external diameter which is smaller than the external diameter of the first tubular section;

a second tubular section having a proximal end, a distal end, an external surface, and an external diameter which is equal to the external diameter of the first tubular section, the proximal end of the second tubular section of the housing being unitary with the distal end of the tubular transition section;

a ring mounted around the tubular transition section for connecting a strap of the shot gun to the flotation device and retained in position around the tubular transition section by the first tubular section and the second tubular section;

a closure cap frictionally mounted on the second tubular section adjacent to the distal end of the second tubular section to close the second tubular section in a watertight manner when the closure cap is in place on the second tubular section; and an inflatable arrangement located in the second tubular section;

the inflatable arrangement being set to activate when it senses water pressure and to inflate to bring the shot gun to a water surface when the flotation device encounters water; and the first tubular section, the tubular transition section, and the second tubular section of the housing being comprised of a one-piece unitary structure.

2. The flotation device of claim 1, wherein the inflatable arrangement comprises:

a water sensitive mechanism fluidically connected to the external surface of the second tubular section;

an inflatable balloon; and a source of gas for inflating the inflatable balloon, the water sensitive mechanism being set to activate when it senses water, and the source of gas being fluidically connected to the inflatable balloon and fluidically connected to the water sensitive mechanism to inflate the inflatable balloon when the water sensitive mechanism is activated as the flotation device enters water.

3. The flotation device of claim 1, wherein the first tubular section, the tubular transition section, and the second tubular section of the housing are comprised of a plastic injection molding.

4. The flotation device of claim 1, wherein the first tubular section, the tubular transition section, and the second tubular section of the housing are comprised of plastic, metal or a combination thereof.

5. The flotation device of claim 1, wherein the inflatable arrangement comprises:

an inflatable bladder;

a housing for storing the inflatable bladder and containing a trigger mechanism;

a $CO_2$ cartridge fluidically connected to the inflatable bladder; and a closure cover; and wherein the trigger mechanism is activated upon contact with water to move the inflatable bladder out of the housing to float the shot gun to the surface of the water.

6. A flotation device mounted on a shot gun, the flotation device comprising:

an attachment adapter having a first end section with internal threads for engaging threads on the shot gun, a middle section, and a second end section with external threads, a frame with internal threads for engaging the external threads of the second end section of the attachment adapter;

an inflatable arrangement secured to the frame;

a sheath which encircles and houses the frame and the inflatable arrangement when the inflatable arrangement is in an inoperative condition and which opens up and is forced away from the inflatable arrangement when the inflatable arrangement is in an operative condition;

a ring mounted around the middle section of the attachment adapter for attaching a strap of the shot gun to the flotation device and retained in position around the middle section of the attachment adapter by the first end section of the attachment adapter and the frame; and the first end section, the middle section, and the second end section of the attachment adapter comprising a three-tiered tubular section with reducing diameters.

7. The flotation device of claim 6, wherein the inflatable arrangement comprises:

a water sensitive mechanism;

an inflatable balloon; and a source of gas for inflating the inflatable balloon, the water sensitive mechanism being set to activate when it enters water, and the source of gas being fluidically connected to the inflatable balloon and fluidically connected to the water sensitive mechanism to inflate the inflatable balloon when the water sensitive mechanism is activated as the flotation device enters water.

8. The flotation device of claim 6, wherein the inflatable arrangement comprises:

an inflatable bladder;

a housing for storing the inflatable bladder and containing a trigger mechanism;

a $CO_2$ cartridge fluidically connected to the inflatable bladder; and a sheath adjacent to the $CO_2$ cartridge, and wherein the trigger mechanism is activated upon contact with water to move the inflatable bladder out of the housing to float the shot gun to the surface of the water.

* * * * *